United States Patent [19]

Marichy

[11] 4,406,405

[45] Sep. 27, 1983

[54] DEVICE FOR THE EJECTION OF DROPLETS AS REQUIRED

[75] Inventor: Gerard Marichy, Sainte Foy-Les-Lyon, France

[73] Assignee: Bertin & Cie, Plaisir, France

[21] Appl. No.: 291,835

[22] Filed: Aug. 10, 1981

[30] Foreign Application Priority Data

Aug. 8, 1980 [FR] France ..... 80 17516

[51] Int. Cl.[3] ..... B05B 3/14

[52] U.S. Cl. ..... 239/102; 239/600; 310/323; 346/140 R

[58] Field of Search ..... 239/102, 600; 310/323, 310/369; 346/75, 140 PD

[56] References Cited

U.S. PATENT DOCUMENTS

| | | | |
|---|---|---|---|
| 3,194,162 | 7/1965 | Williams | 239/102 |
| 4,034,025 | 7/1977 | Martner | 239/102 |
| 4,068,144 | 1/1978 | Toye | 346/140 PD |
| 4,095,238 | 6/1978 | Kattner et al. | 346/140 PD |
| 4,123,481 | 10/1978 | Herold et al. | 239/102 |
| 4,158,847 | 6/1979 | Heinzl et al. | 346/140 PD |
| 4,267,976 | 5/1981 | Chatwin | 239/102 |
| 4,296,417 | 10/1981 | Markham et al. | 346/140 R |
| 4,303,927 | 12/1981 | Tsao | 346/140 R |

FOREIGN PATENT DOCUMENTS

| | | | |
|---|---|---|---|
| 784940 | 12/1980 | U.S.S.R. | 239/102 |

OTHER PUBLICATIONS

"Ink Jet Head", J. H. Meier, IBM Technical Disclosure Bulletin, vol. 16, No. 6, Nov. 1973, p. 1833.

*Primary Examiner*—John J. Love
*Assistant Examiner*—Michael J. Forman
*Attorney, Agent, or Firm*—A. W. Breiner

[57] ABSTRACT

A device for the production of ink droplets as required includes a nozzle fed with liquid through a pipe connected to a tank and associated with a pressure transducer which produce pulsations in the liquid. The pressure transducer exhibits an internal cavity of very small volume with an inlet and an outlet for the liquid which is lying directly in contact with the wall of the material of the pressure transducer, this inlet being connected to the tank of liquid and to the outlet feeding the nozzle.

3 Claims, 3 Drawing Figures

DEVICE FOR THE EJECTION OF DROPLETS AS REQUIRED

BACKGROUND OF THE INVENTION

1. Field of the Invention

The present invention refers to the production of droplets as required and is applicable especially to carrying out inkprojection printing.

2. Description of the Prior Art

Devices for producing drops as required are already known, which include at least one nozzle fed with liquid through a pipe connected to a tank of liquid and associated with a pressure transducer generating pulsations in the liquid. The pressure transducer which is generally tubular and of piezoelectric type surrounds the pipe in the vicinity of the nozzle. When it is excited by an electric voltage pulse it contracts and acts upon the liquid by way of the pipe, the pressure wave thus created expelling a droplet out of the orifice of the nozzle.

In a device of this species, described, for example, in the French Pat. No. 75 38 342 (Pub. 229485o), it is necessary to provide means for preventing the arrival of air bubbles in the nozzle, which would disturb its operation. In the aforesaid Patent Application a capillary filter means is employed for the purpose.

SUMMARY OF THE INVENTION

The present invention does away with the obligation to provide a means for the elimination of air bubbles. On the other hand it enables a maximum ejection effect to be applied upon the liquid by the pressure transducer.

In accordance with the invention the pressure transducer exhibits an internal cavity of very small volume with an inlet and an outlet for the liquid which is lying directly in contact with, and thus wets the exposed wall of the pressure transducer, the said inlet being connected to the tank of liquid and the said outlet feeding the nozzle.

Because there is no intermediary between the liquid and the bar wall of the transducer it is possible to define a very small cavity volume; the result is firstly that the pulses generated by the transducer will have a very considerable effect upon the liquid, and secondly that the cavity prevents practically all of the bubbles from arriving as far as the nozzle. Hence a special system of elimination of the bubbles is not compulsory.

The pressure transducer may advantageously be a piezo-electric transducer, a transducer having electrets or any other device capable of generating a pressure pulse. The shape of the cavity may be annular, cylindrical, or other.

The invention is applicable in particular to ink-projection printing for paper, cloth, and the like.

Writing may be carried out either with a plurality of nozzles (printing in a matrix or in a mosaic) or with one nozzle, the drops of ink being then deflected as a function of the writing commands which are transmitted.

DESCRIPTION OF THE PREFERRED EMBODIMENT

Figure 1:
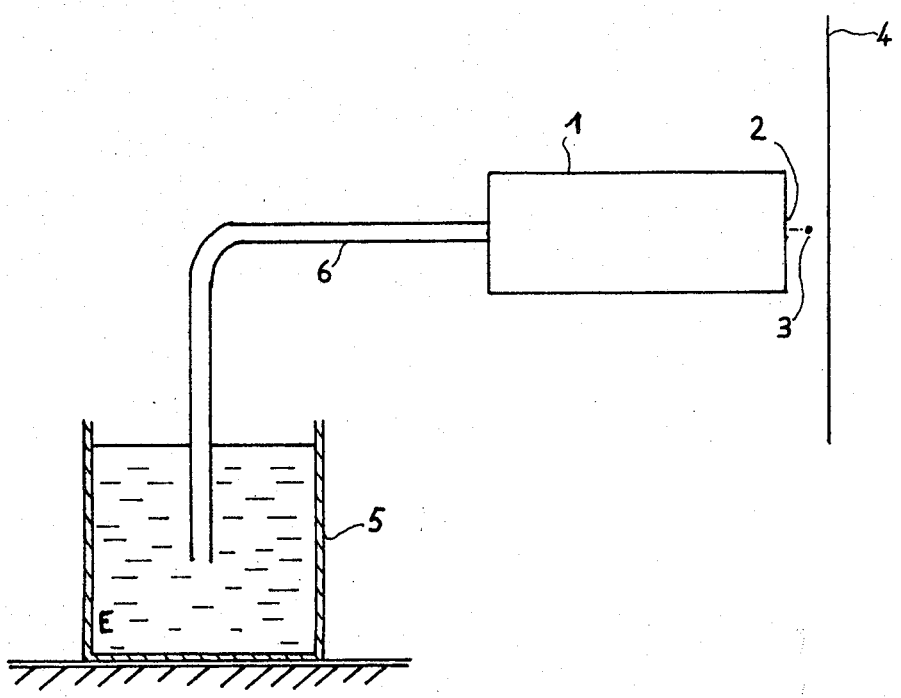
FIG. 1 is a diagrammatic illustration of the overall arrangement of the invention.
Figure 2:
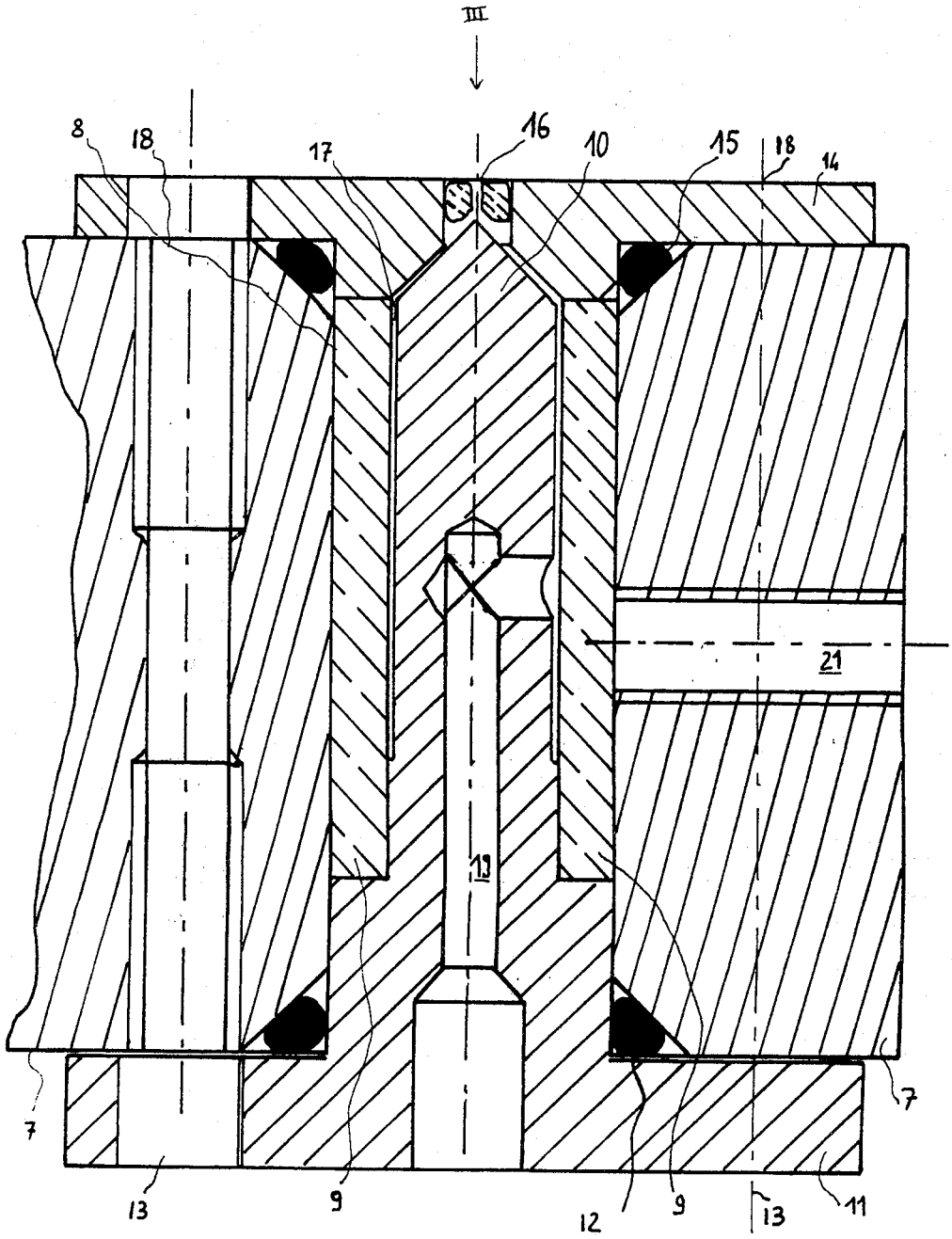
FIG. 2 is a section taken along the line II—II in FIG. 3 to illustrate the detail of the execution of a droppro-ducer.
Figure 3:
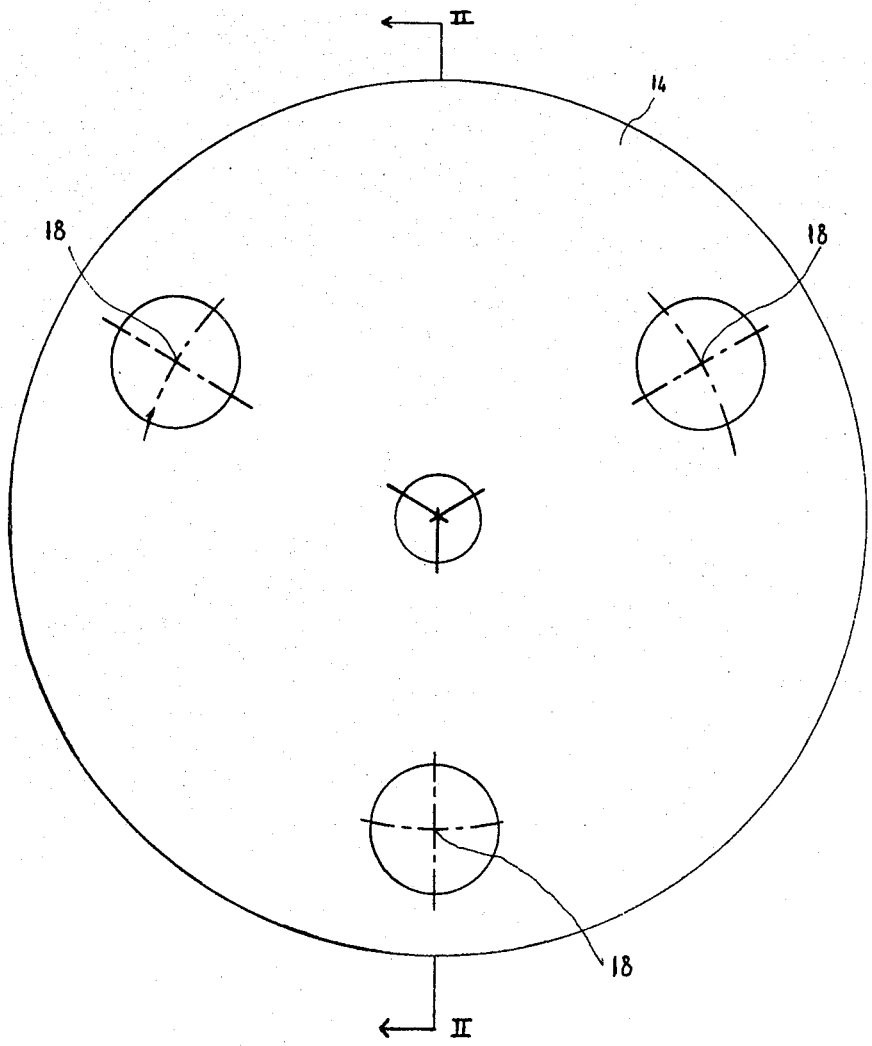
FIG. 3 is a front view of a droplet-producer in the direction of the arrow III in FIG. 2.

FIG. 1 illustrates diagrammatically an embodiment of an assembly for the ejection of droplets. The drop-producer 1 through its nozzle 2 sends the drops 3 towards the support 4 which is to be marked. The producer 1 is connected to a tank 5 of liquid, of ink E, of example, by way of a pipe 6. FIGS. 2 and 3 illustrate the detail of the execution of the drop-producer 1.

The latter includes a support 7 in the form of a bush in which is drilled a cylindrical base 8. In this base is inserted the piezo-electric transducer 9. The latter appears in the form of a sleeve or tube of piezo-electric ceramic which defines an internal cavity of relatively large volume. In order to reduce the free volume of the cavity a cylindrical case 10 is arranged in it, which is integral with a stopper 11 which ensures by a toroidal seal 12 the closing off of the base 8 at one end of it. The stopper 11 is attached at 13 (for example, by bolts which are not shown) to the support 7.

The other end of the base 8 is closed by a plate 14 associated with a seal 15 and bearing the nozzle 16. This plate is attached at 18 to the support 7.

Through these arrangements an annular clearance 17 of very small volume is formed between the piezo-electric transducer 9 and the cylindrical member 10. This clearance is fed with liquid through a channel 19 arranged in the cylindrical case 10 and the cover 11, this channel being connected to the tank of ink 5 through the pipe 6. It is to be observed that this inlet pipe-work 19 is of sufficiently large cross-section not to offer significant restriction of the flow of ink.

The clearance 17 opens out into the nozzle 16. For the supply of electric voltage to the piezo-electric transducer 9 a channel 21 is provided in the support 7.

In operation, the electrical signals sent to the transducer 9 cause a contraction of the ceramic and an abrupt ejection of a drop through the nozzle 16. This effect is the greater, the smaller the volume of the clearance 17, and because the tubular transducer 9 is restrained over its outer surrface by the hooping wall 8 of the bush 7 and hence can deform only towards the inside, which considerably increases the amplitude of the contraction thickness of clearance 17.

Ink is then brought into the injector by capillarity upon the return of the piezo-electric element 9 into its rest position. Thus the carrying over of bubbles into the cavity is unlikely.

The tank 5 may be at sub-pressure with respect to the clearance 17 in the producer 1 or at a slight overpressure. Priming is effected by putting the tank 5 under slight overpressure with respect to the clearance 17 in the producer 1.

Tests carried out by the Applicant have given satisfactory results with the following values given by way of indication:

| | | |
|---|---|---|
| Diameter of the nozzle: | 35 μm | 100 μm |
| Diameter of the casing: | 0.1 mm | 0.4 to 0.5 mm |
| Frequency employable: | 2 to 5 kHz | 2.5 (to 5) kHz |
| Speed of movement: | 50 cm/s | 1 to 2 m/s |

The invention is applicable particularly to the case in which one is writing with a nozzle the droplets from which are deflected by a device for deflection as a function of the writing command. It is equally applicable to the case in which one is writing with a plurality of nozzles in a matrix or in a mosaic, the drops of ink falling directly onto the support which is to be marked.

The invention is not restricted to the embodiment which has just been described by way of example. In particular, instead of employing a piezo-electric transducer it is possible to employ a pressure transducer having electrets.

I claim:

1. An ink or other liquid jet apparatus of the kind designed for projecting droplets from a nozzle upon controlled constriction of a radially-squeezable liquid-filled thin-annular clearance communicating with said nozzle and formed between an inner generally cylindrical wall of a tubular piezoelectric or like pressure transducer and an outer generally cylindrical surface of a core housed therein, said surface being radially spaced inwardly of said wall to define said clearance, wherein the improvement comprises hooping means extending all around said tubular transducer to engage positively the outer surface thereof for restricting the same against outward deformation while leaving unrestricted inward deformation thereof, whereby the deformation capacity of said tubular transducer is focused inwardly and devoted to thickness variation of said thin-annular clearance.

2. Apparatus according to claim 1 wherein the hooping means comprises a bush having a bore in which the tubular transducer is tightly fitted.

3. Apparatus according to claim 1, wherein the core is a generally solid member formed with a liquid supply duct leading at one end into the thin-annular clearance and connectable at the other end to an external liquid reservoir, said supply duct being throughout of wide enough cross-section area not to exert significant restriction upon the flow of supply liquid all the way towards said clearance.

* * * * *